US008176963B1

(12) United States Patent
Motosko

(10) Patent No.: US 8,176,963 B1
(45) Date of Patent: May 15, 2012

(54) STORM SHUTTER PANEL AND SYSTEM WITH LIGHT OPENINGS

(76) Inventor: Stephen J. Motosko, Sarasota, FL (US)

( * ) Notice: Subject to any disclaimer, the term of this patent is extended or adjusted under 35 U.S.C. 154(b) by 55 days.

(21) Appl. No.: 11/787,975

(22) Filed: Apr. 18, 2007

(51) Int. Cl.
*E06B 3/48* (2006.01)

(52) U.S. Cl. ..... 160/118; 160/133; 160/199; 52/203

(58) Field of Classification Search ..... 52/202, 52/203; 40/583; 362/252, 236; 160/118, 160/133, 183, 199, 236
See application file for complete search history.

(56) References Cited

U.S. PATENT DOCUMENTS

| | | | | | |
|---|---|---|---|---|---|
| 1,131,399 | A | * | 3/1915 | McGinley | 285/154.1 |
| 1,746,926 | A | * | 2/1930 | Boyle, Jr. | 220/300 |
| 1,977,788 | A | * | 10/1934 | Allen | 52/208 |
| 2,444,268 | A | * | 6/1948 | Peters | 220/266 |
| 2,733,052 | A | * | 1/1956 | Luther | 366/205 |
| 2,866,572 | A | * | 12/1958 | Llewhellin | 220/293 |
| 3,010,673 | A | * | 11/1961 | Marconi | 242/405.2 |
| 3,366,267 | A | * | 1/1968 | Boyer | 220/309.2 |
| 3,531,011 | A | * | 9/1970 | Wolfe | 220/298 |
| 3,672,547 | A | * | 6/1972 | Kozlowski | 222/567 |
| 3,677,434 | A | * | 7/1972 | Boyer | 220/324 |
| 4,129,020 | A | * | 12/1978 | Gonzalez | 70/417 |
| 4,133,560 | A | * | 1/1979 | Ishikawa et al. | 285/81 |
| 4,334,630 | A | * | 6/1982 | Bergin | 220/300 |
| 4,702,388 | A | * | 10/1987 | Boyer et al. | 220/305 |
| 4,756,638 | A | * | 7/1988 | Neyret | 403/261 |
| 4,765,165 | A | * | 8/1988 | O'Gara | 70/417 |
| 4,792,087 | A | * | 12/1988 | Russell | 229/125.15 |
| 5,069,357 | A | * | 12/1991 | Anderson | 220/787 |
| D324,636 | S | * | 3/1992 | Schlack et al. | D8/331 |
| 5,347,673 | A | * | 9/1994 | Nickels, Jr. | 15/97.1 |
| 5,596,849 | A | | 1/1997 | Hill | |
| 5,787,642 | A | | 8/1998 | Coyle et al. | |
| 5,947,295 | A | * | 9/1999 | Lutin | 206/554 |
| 5,996,292 | A | | 12/1999 | Hill et al. | |
| 6,022,167 | A | * | 2/2000 | Andress et al. | 403/348 |
| 6,056,148 | A | * | 5/2000 | Ferguson et al. | 220/676 |
| 6,209,263 | B1 | | 4/2001 | Poirier | |
| 6,305,725 | B1 | * | 10/2001 | Antonucci et al. | 292/67 |
| 6,345,476 | B1 | | 2/2002 | Hill | |
| 2002/0152781 | A1 | * | 10/2002 | Teskey | 70/371 |
| 2003/0209547 | A1 | * | 11/2003 | Lin | 220/254.8 |

* cited by examiner

*Primary Examiner* — William Gilbert
*Assistant Examiner* — James Ference
(74) *Attorney, Agent, or Firm* — Gifford, Krass, Sprinkle, Anderson & Citkowski, P.C.

(57) ABSTRACT

An accordion-style storm shutter panel and system for use in covering an opening in a building structure including an outer frame assembly and a plurality of vertically mounted elongated panels foldably connected together in accordion style fashion. The panels are joined by slip fitted lateral knuckle joints and a track engaging a guide which extends from ends of the knuckle joints. A plurality of spaced apertures are formed through and extend over the substantial length of each of the panels, each of said apertures preferably having a notch-and-tab arrangement extending around a periphery thereof. A plurality of transparent, translucent or opaque locking plugs are sized and have a spaced locking tab arrangement around a periphery thereof, which matably and releasably lockingly engages within each aperture. Alternately, the plugs may be fixed in place and be light-transmitting.

5 Claims, 8 Drawing Sheets

FIG 1
(PRIOR ART)
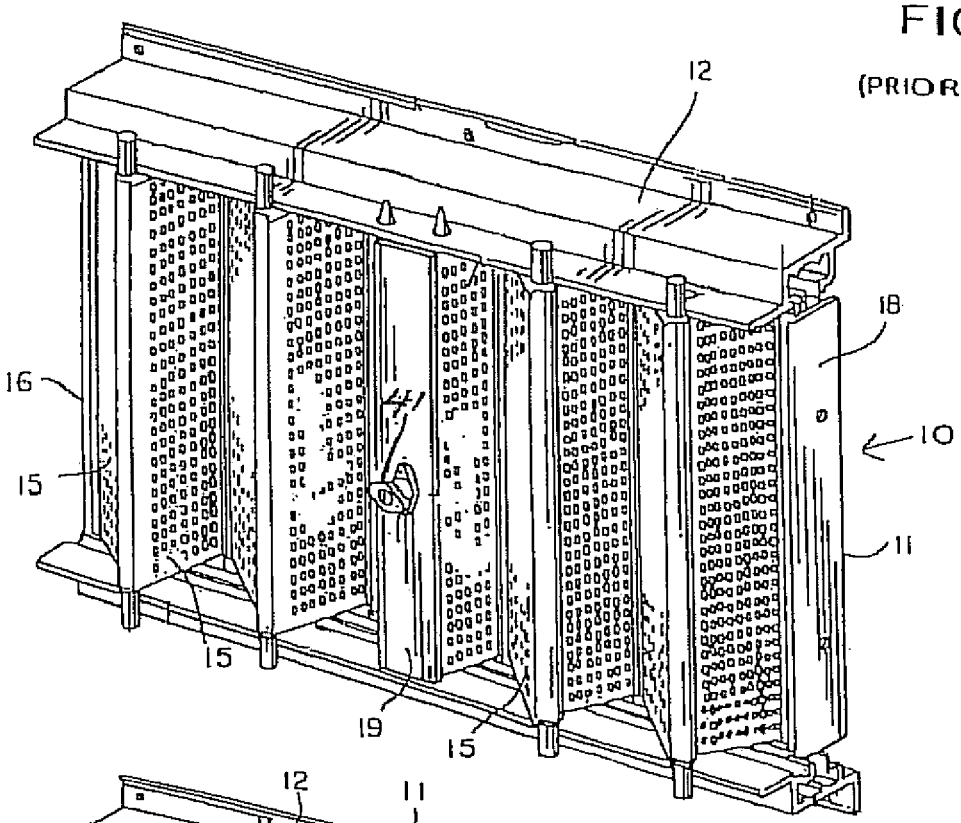
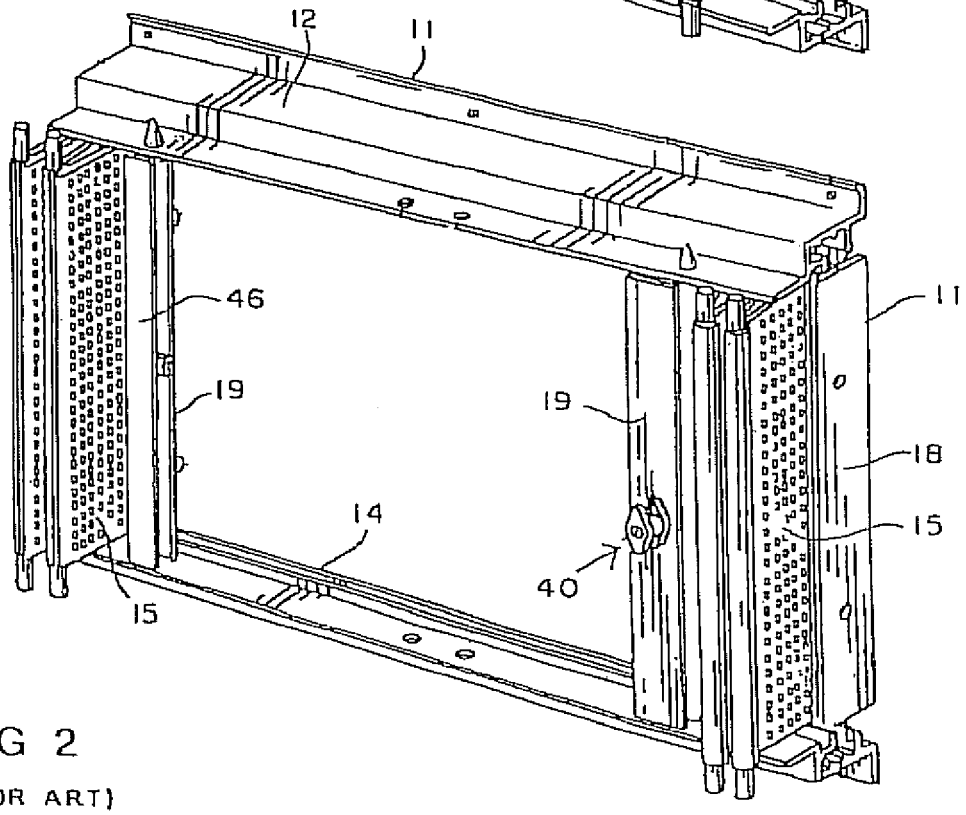
FIG 2
(PRIOR ART)

120
128
118
120
116
128
114
122

STORM SHUTTER PANEL AND SYSTEM WITH LIGHT OPENINGS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to storm shutter systems which are readily deployable during a storm or hurricane threat, and more particularly to a storm shutter panel and system which incorporates a preferably removable plug lockably engageable into apertures formed in each of the panels such that, when these plugs, in the preferred transparent or translucent embodiment, are removed, substantial amounts of light enter into the interior of the building without removal or opening of the panels and shutter system themselves.

2. Description of Related Art

A broad array of prior art approaches to protecting the interior of a building from window damage and subsequent water and interior wind damage during heavy storms and hurricanes are well known. One form of protection includes the deployment of solid panels across the window and door openings to prevent damage thereof from flying objects during the storm. However, such a simplistic approach typically blocks off all light from entering the interior of the building and for those occupants therewithin during the storm, the dread and threat of hurricane damage is multiplied should electric power be interrupted and complete darkness envelop the occupants.

To provide some semblance of light without the need for dismantling of a hurricane shutter system over windows and doors, Hill, in U.S. Pat. No. 6,345,476, has provided a perforated pleated shutter system with small perforations over a substantial surface area of each of the pleated shutters. Hill teaches other forms of perforations in protective window shutter systems which are not pleated and easily openable for broad light input while also having fixed open perforations for smaller amounts of light while still affording protectability to the interior of the building from flying object damage to the window structure. These prior Hill patents include U.S. Pat. Nos. 5,996,292, 5,596,849 and 5,487,244.

Coyle, in U.S. Pat. No. 5,787,642 discloses a storm shutter with light transmittance which includes a fixed polycarbonate transparent sheet covered over by an expanded aluminum element mounted snuggly in the peripheral frame and against or immediately outside of the polycarbonate sheet.

The present invention provides an accordion style storm shutter system and panel therefor which, when deployed or closed during a storm threat, includes removable or fixed plugs fitted into mating apertures typically almost as wide as the width of the panel extending along a substantial length of each panel. When transparent or translucent plugs are inserted and releasably engaged into the mating apertures, full hurricane protection is afforded, the plugs alternately being opaque and removable to provide a substantial amount of the hurricane protection while allowing a significant amount of light to enter into the interior of the building. Because the holes or apertures are limited to a width of the panel in the range of approximately 4" or smaller, only small flying objects have a chance of penetrating through the apertures when the plugs are removed.

BRIEF SUMMARY OF THE INVENTION

This invention is directed to an accordion-style storm shutter panel and system for use in covering an opening in a building structure including an outer frame assembly and a plurality of vertically mounted elongated panels foldably connected together in accordion style fashion. The panels are joined by slip fitting lateral knuckle joints and a track engaging a guide which extends from ends of the knuckle joints. A pattern of spaced apertures are formed through and extend over the substantial length of each of the panels, each of said apertures preferably being transparent or translucent and having a notch-and-tab arrangement extending around a periphery thereof. A plurality of locking plugs are sized and have a spaced locking tab arrangement around a periphery thereof, which matably and releasably lockingly engages within each aperture. Alternately, the plugs may be opaque or may be fixed in place or may also be accessible for removal only from the inside of the building.

It is therefore an object of this invention to provide a light-transmitting decorative shutter panel and system which will open and close in accordion style fashion and which will selectively, by transparency, translucency or removal, allow large amounts of light to penetrate into the interior of a building without substantially compromising the hurricane wind protection benefits required by current building code law.

Still another object of this invention is to provide a hurricane panel which includes removable opaque plugs which may easily removed with the panels in a shutter system closed in accordion fashion across a window or doorway, the plugs being easily removable without the need for opening the shutter system for enhanced light penetration into the building interior.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIG. 1 is a perspective view of a pleated shutter system taken from prior art reference U.S. Pat. No. 6,345,476 to demonstrate the typical environment of the present invention.

FIG. 2 is a view of FIG. 1 showing the pleated panels in the open position.

DETAILED DESCRIPTION OF THE INVENTION

Prior Art

Figure 3:
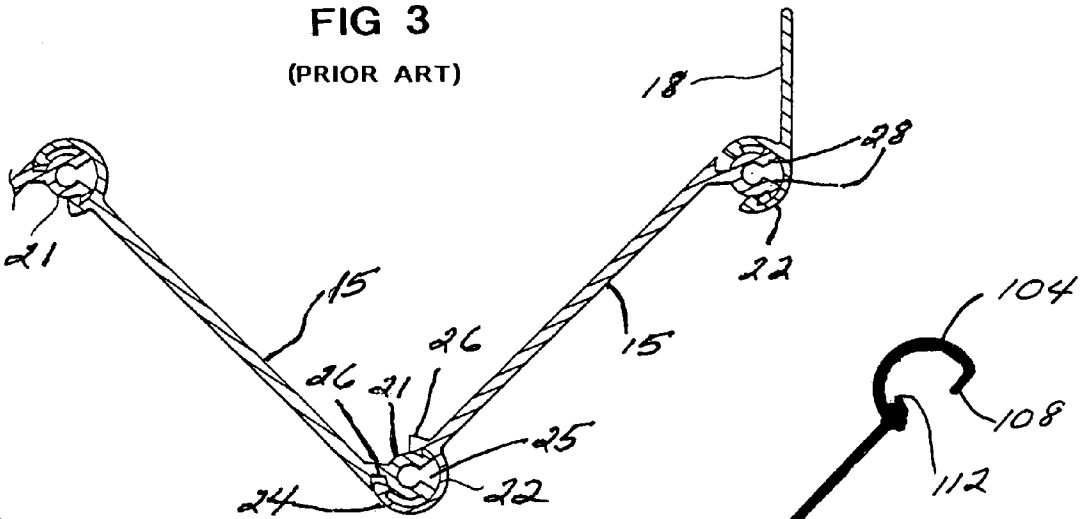
FIG 3 (PRIOR ART)
FIG. 3 is a transverse section view of the pleated members of FIG. 1 or 2 showing the interlocking structure of the panels.

Referring initially to FIGS. 1 to 3, a pleated shutter system 10 is shown in FIGS. 1 and 2 taken from U.S. Pat. No. 6,345,476. In FIG. 1 it is shown closed covering the opening in a dwelling. In FIG. 2 it is shown open, to open the access to the dwelling where the shutter is installed. In both instances the pleated shutter system 10 includes an outer frame 11 made up of a header 12, a footer 14, a plurality of pleated panels 15, a left end plate 16, and a right end plate 18. A center lock assembly 19 is provided as shown in FIG. 1. The center lock assembly 19, in turn, utilizes a latch lock assembly vertical member 40, said latch lock assembly having a handle 41, and the same mounting into a latch catch assembly 46.

Turning now to FIG. 3 it will be seen that each panel 15 has an inner panel knuckle 21, and an outer panel knuckle 22. Each knuckle, in turn, has a jaw denoted as outer jaw 24 and inner jaw 25. In addition, there are outer jaw stops 26, and inner jaw stops 28 which restrict the angle of rotation of the joint assembly of the inner panel knuckle 21 and outer panel knuckle 22. The relationship between the adjacent panels 15 and the lock panel end plate portion 18 of the end plate on the right-hand side. The panels 15 each have a panel inner knuckle 21 and a panel outer knuckle 22. The same are proportioned so that the inner knuckle 21 slidably engages the outer knuckle 22.

The Invention

Figure 3A:
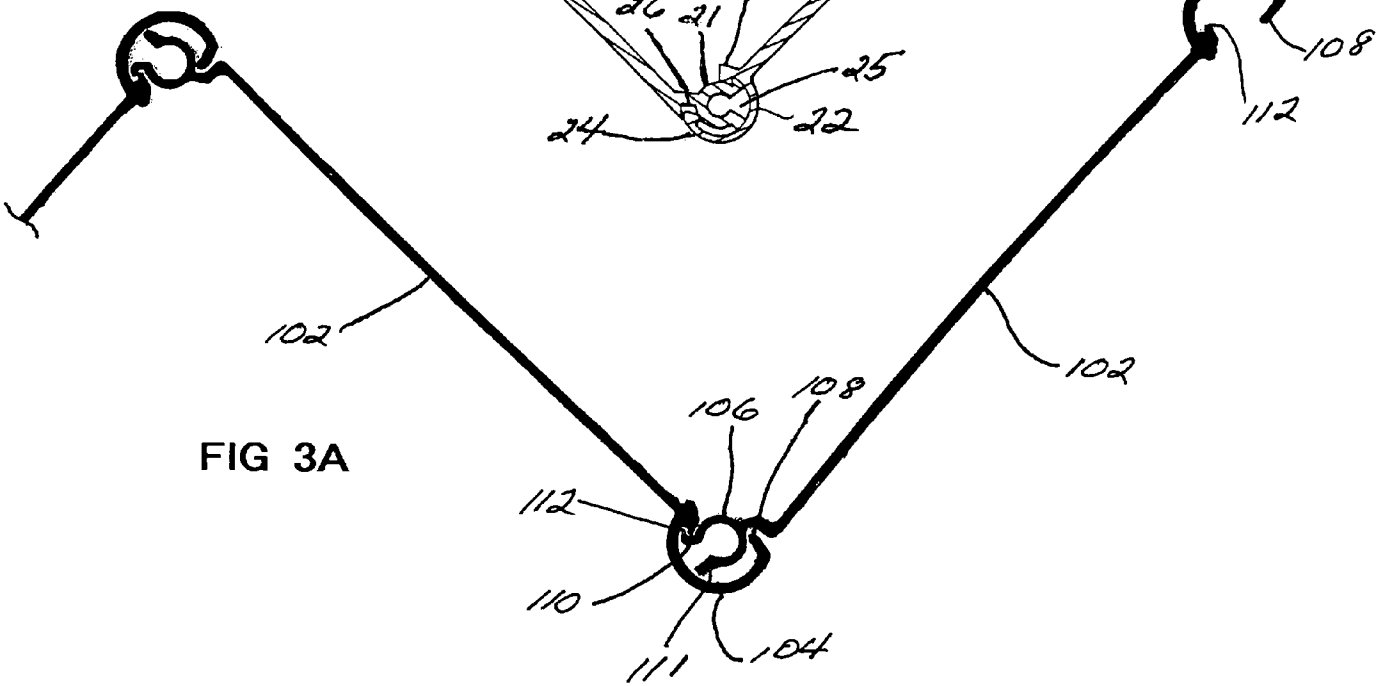
FIG. 3A is a view similar to FIG. 3 showing the plug interlocking features of the panels of the present invention.
Figure 4:
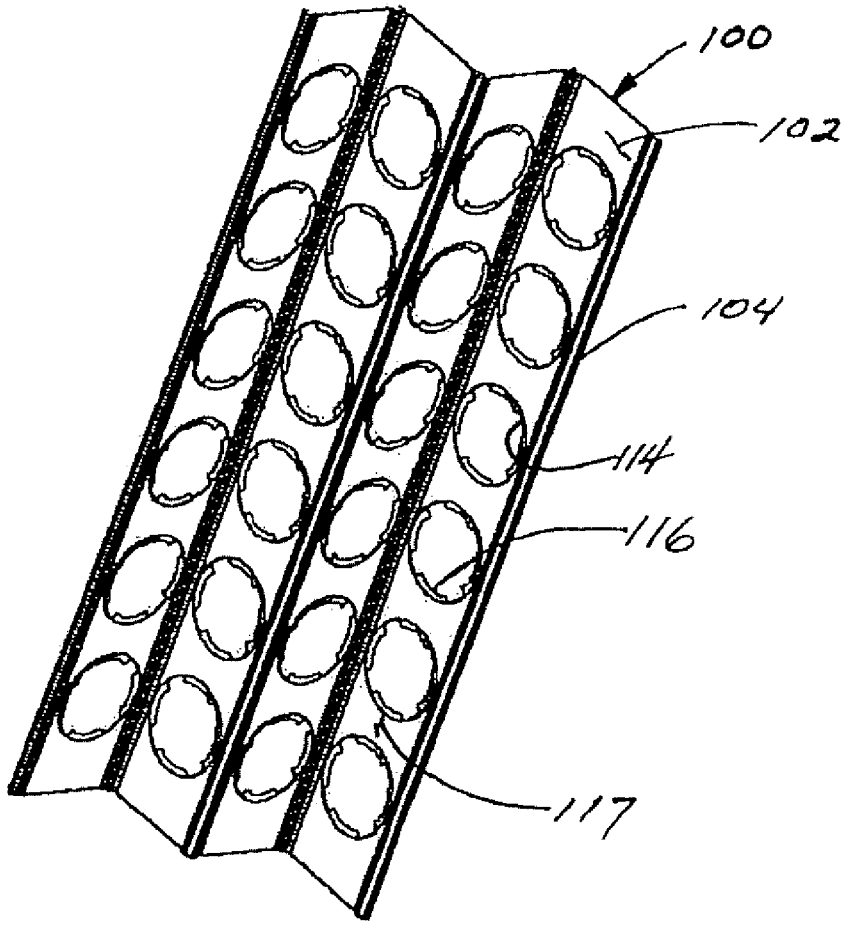
FIG. 4 is a perspective view of a representative sample of a plurality of interconnected panels of the present invention.

Referring now to FIGS. 3A and 4, individual panels 102 of a shutter assembly 100 is there shown. The individual panels 102 are fabricated of thin rolled sheet aluminum having a thickness of about 1/16" and a generally flat center portion of about 4" in width. An inner knuckle 106 and an outer knuckle 104 are formed along each edge of each panel 102. The outer knuckle 104 includes stops 108 and 112, while the inner knuckle 106 includes stops 110 and 111 which stops cooperate to restrict the angle of rotation of the joint assembly of the panel knuckles 104 and 106.

Figure 5:
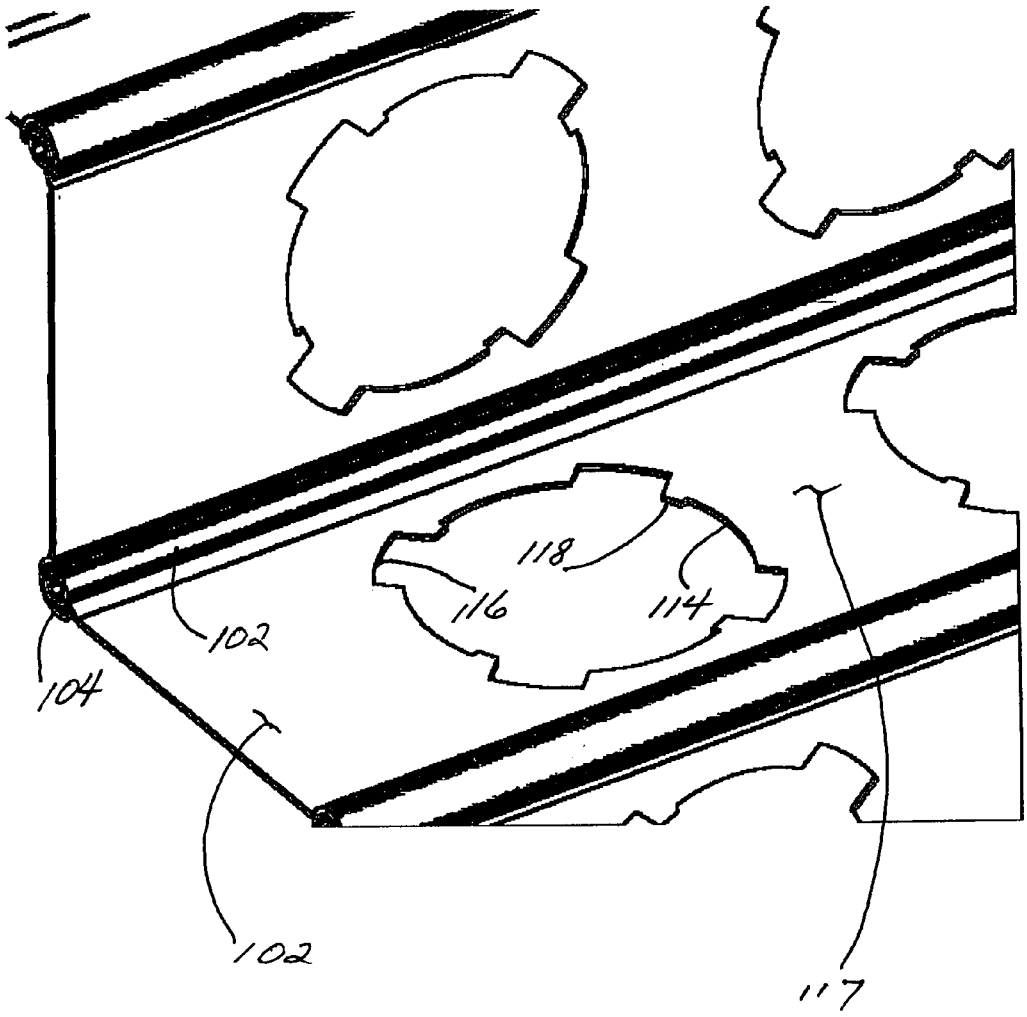
FIG. 5 is an enlarged view of FIG. 4.

As seen in FIGS. 4 and 5, each of the panels 102 include a plurality of spaced apertures 114 each of which is formed through the panel and which extend over a substantial length of each of the panels 102. Each aperture 114 includes a notch 116 and a tab/stop 118 formed around the periphery of each of the apertures 114 as best seen in FIG. 5. Spacing 117 between each of the apertures 114 is approximately ½ to ⅔ of the transverse width of the aperture 114, leaving sufficient panel material to render each of the panels 102 in the panel assembly 100 sufficiently strong, in combination with the interengaged knuckle arrangement previously described, to serve as a flying debris protectant of windows and doors therebehind during a hurricane or tornado.

Figure 6:
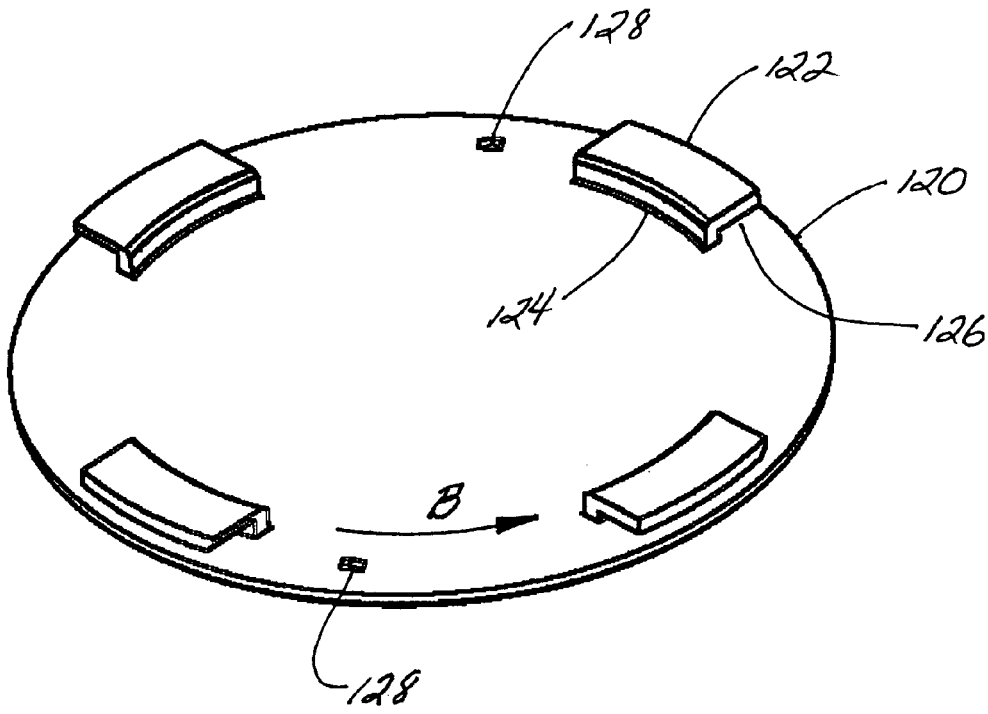
FIG. 6 is a perspective view of the interlocking plug connectable into the apertures formed through the panels of FIGS. 4 and 5.
Figure 8:
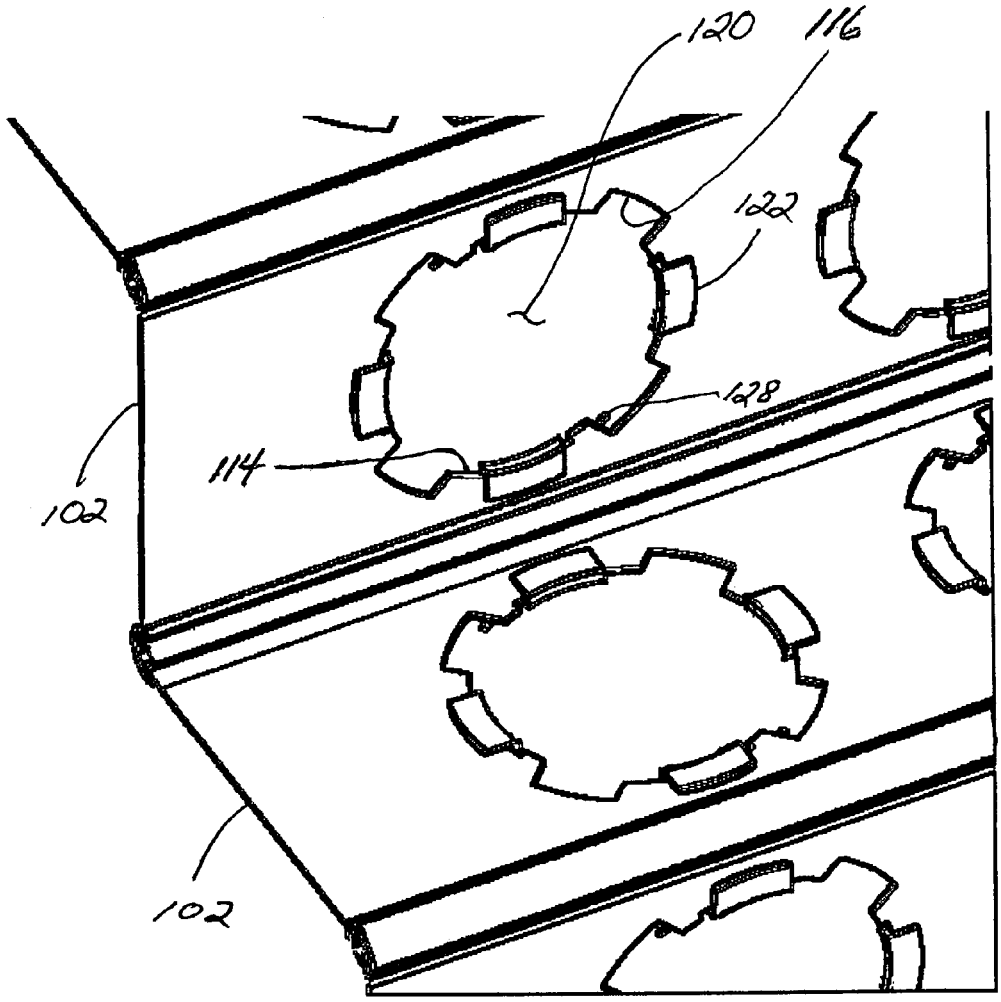
FIG. 8 is an enlarged view of FIG. 7.
Figure 9:
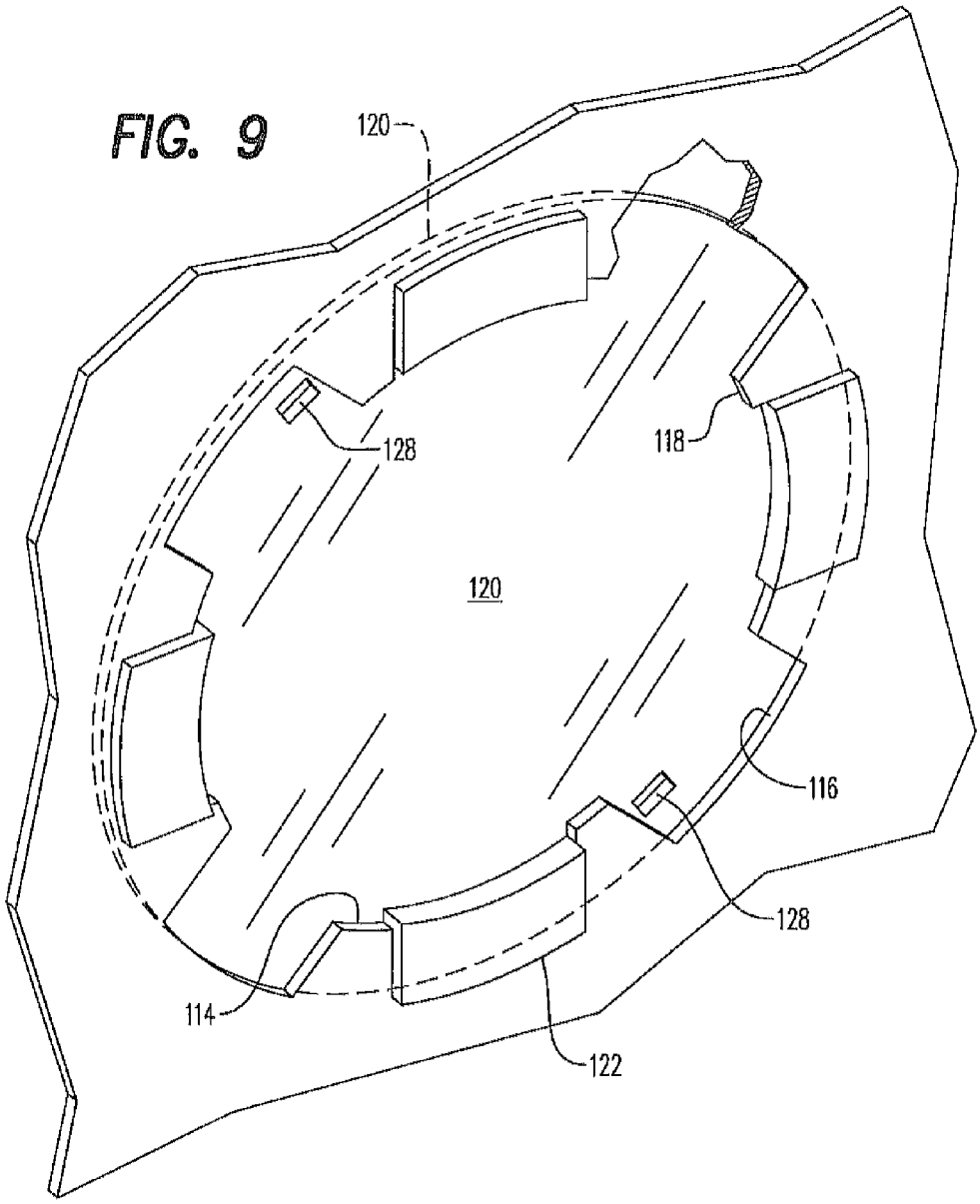
FIG. 9 is an enlargement of a portion of FIG. 8.

Referring now to FIG. 6, the invention also includes a plurality of locking plugs 120 each sized and having locking tabs 122 formed thereon which preferably releasably lockingly engage within one of the apertures 114 within panels 102. Each locking tab 122 attached along an inner arcuate edge 124 thereof directly to the plug 120 provides an offset gap 126 generally equal to the thickness of the panel material for tight secure rotatable locking engagement of each plug 120 within the notched and tabbed apertures 114. Thus, when each plug 120 is inserted into one of the apertures 114 with tabs 122 aligned with the notches 116 and rotated in the direction of arrow B as facilitated by the insertion of a tool into one or both tool receiving holes 128. The end of each tab 122 abuts against stop 118, the plug 120 is securely and releasably affixed within the corresponding apertures 114 to add strength to the panel/plug assembly designated at 130 in FIGS. 7, 8 and 9.

Figure 7:
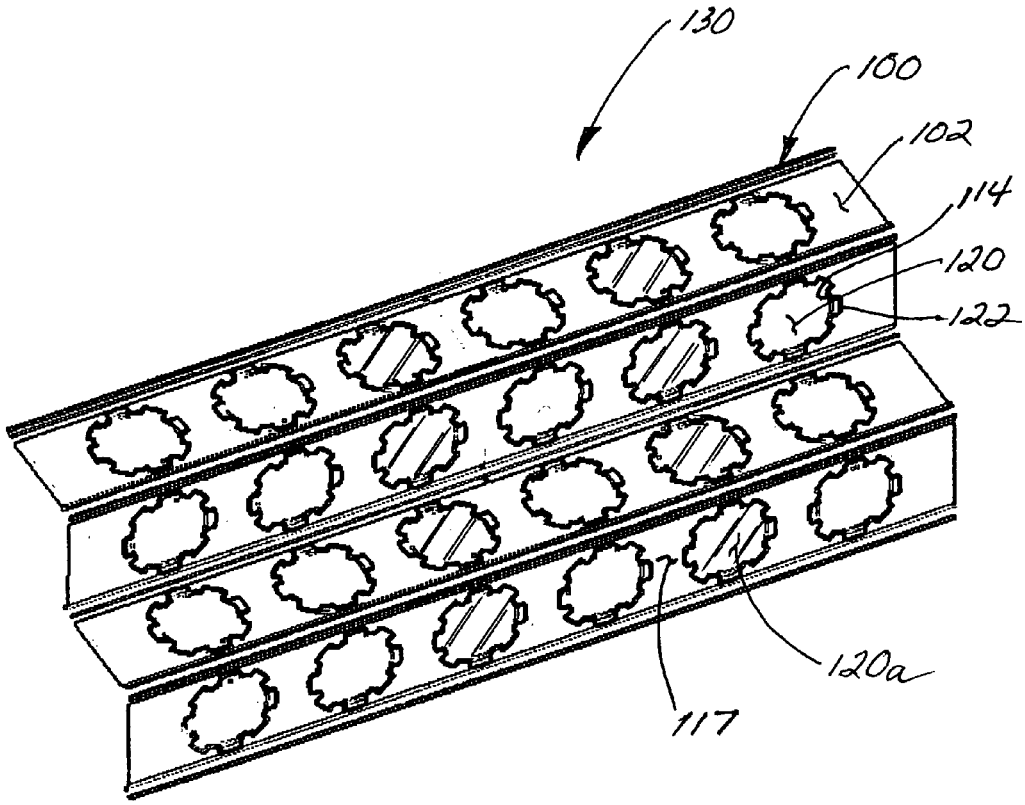
FIG. 7 is a view similar to that of FIG. 4 showing each of the apertures sealed closed with one of the interlocking plugs of FIG. 6.

Still referring to FIG. 7, alternately, the locking plugs 120*a* may be transparent or translucent so that a sufficient amount of light is transferred therethrough without removal thereof. By this embodiment which is preferred, the strength and integrity of the protective aspect of the invention is not lost to small pieces of flying debris which could pass through the unplugged apertures and break the window, compromising the integrity of the interior of the building. Further, the locking plugs 120*a* may be rendered non-removable on installation as the transparency or translucency allows for permanent light transference without the need for removal. Lastly, the tool-receiving holes 128 may be formed only partially through the locking plug 120 from the interior or inner surface of the locking plug 120 so that access thereto for removal is only made available from the interior of the building. This feature is important for security purposes so that an intruder may not easily gain access for window breakage by the simple removal of the locking plug 120.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. An accordion-style storm shutter system for protectively covering an opening in a building structure, said storm shutter system comprising:

an outer frame having two pair of opposing sides;

a plurality of flat panels, said plurality of panels being hingedly connected together in accordion style fashion to permit opening and closing against one pair of said two pair of opposing sides;

said panels having a plurality of spaced circular apertures formed therein, each of said apertures having a plurality of notches which extend radially outwardly from a circular perimeter of each of said apertures, each of said apertures having a least one stop tab extending radially inwardly from said circular perimeter; and a plurality of locking plugs, each of said locking plugs having a flat body having a diameter greater than a diameter of said plurality of apertures, said plurality of locking tabs being positioned on said flat body to corresponding to said plurality of notches, said locking tabs having a generally L-shape such that a portion of each of said locking tabs is laterally offset from a surface of said flat body of said locking plugs;

each of said locking plugs being received within one of said plurality of apertures and rotated such that a portion of said panel adjacent said circular perimeter of said aperture is positioned between said portion of said locking tab offset from said flat body and said flat body to retain said locking plug within said aperture and wherein said at least one stop tab abuts one of said plurality of locking tabs to limit rotation of said locking plugs within said apertures.

2. The accordion-style storm shutter system of claim 1, wherein adjacent panels are hingedly connected by slip fitted lateral knuckle joints having guides which extend from ends of said knuckle joints, and wherein said guides engage with a track formed on said one pair of said two pair of opposing sides of said outer frame.

3. The accordion-style storm shutter system of claim 1, wherein said locking plugs are formed as a one-piece unit.

4. The accordion-style storm shutter system of claim 1, wherein said plurality of locking plugs are formed of a transparent or translucent material.

5. The accordion-style storm shutter system of claim 1, wherein said at least one stop tab and one of said plurality of said notches shares a common edge that extends radially outwardly from said circular perimeter to define an edge of said notch and extends radially inwardly from said circular perimeter to define an edge of said at least one stop tab.

* * * * *